United States Patent [19]

Steppe et al.

[11] Patent Number: 4,930,918

[45] Date of Patent: Jun. 5, 1990

[54] OFFICE MACHINE, IN PARTICULAR MATRIX PRINTER

[75] Inventors: Erich Steppe, Ulm; Dieter Beth, Elchingen, both of Fed. Rep. of Germany

[73] Assignee: Mannesmann Aktiengesellschaft, Düsseldorf, Fed. Rep. of Germany

[21] Appl. No.: 246,077

[22] Filed: Sep. 19, 1988

[30] Foreign Application Priority Data

Oct. 16, 1987 [EP] European Pat. Off. ..... 87730131.7

[51] Int. Cl.[5] ..... B41J 29/00

[52] U.S. Cl. ..... 400/719; 337/8; 337/11

[58] Field of Search ..... 337/8, 11; 361/432; 200/51.09, 51.1, 280, 281; 439/166, 171, 173, 174, 189, 221, 217, 218

[56] References Cited

U.S. PATENT DOCUMENTS

| | | | |
|---|---|---|---|
| 2,907,849 | 10/1959 | Kobryner | 439/221 |
| 3,728,586 | 4/1973 | Inhelder | 337/4 |
| 4,307,367 | 12/1981 | Mellentin | 337/38 |
| 4,393,283 | 7/1983 | Masuda | 200/51.09 |
| 4,462,708 | 7/1984 | Luartes | 400/63 |
| 4,467,398 | 8/1984 | Weber | 337/11 |
| 4,488,201 | 12/1984 | Webb | 337/8 |
| 4,489,300 | 12/1984 | Hollenstein | 337/186 |
| 4,685,028 | 8/1987 | Miller | 337/8 |

*Primary Examiner*—David A. Wiecking
*Assistant Examiner*—Steven S. Kelley
*Attorney, Agent, or Firm*—Horst M. Kasper

[57] ABSTRACT

In an office machine, in particular in a matrix printer which is provided with a power grid component (3) for the power supply of the electrical or, respectively, the electronic circuits and which includes a safety fuse on the power grid input side, there is disclosed for purposes of more clarity of the construction, for an easier operability and for protection against false connection, that a multiple safety fuse socket (6) for at least two melting safety fuse bodies (9, 10) is coordinated to a voltage selection switch (7). The multiple safety fuse socket (6) can be placed in different relative geometric positions with respect to the voltage selection switch (7) into a fuse socket (8). A selected voltage is coordinated at the voltage selection switch (7) in each position of the multiple safety fuse socket (6).

19 Claims, 2 Drawing Sheets

FIG. 3
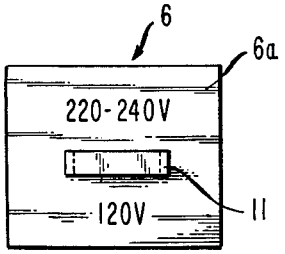
FIG. 5
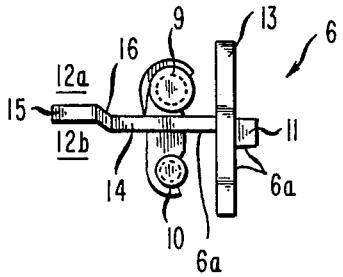
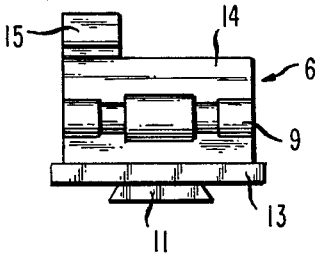
FIG. 4
FIG. 6
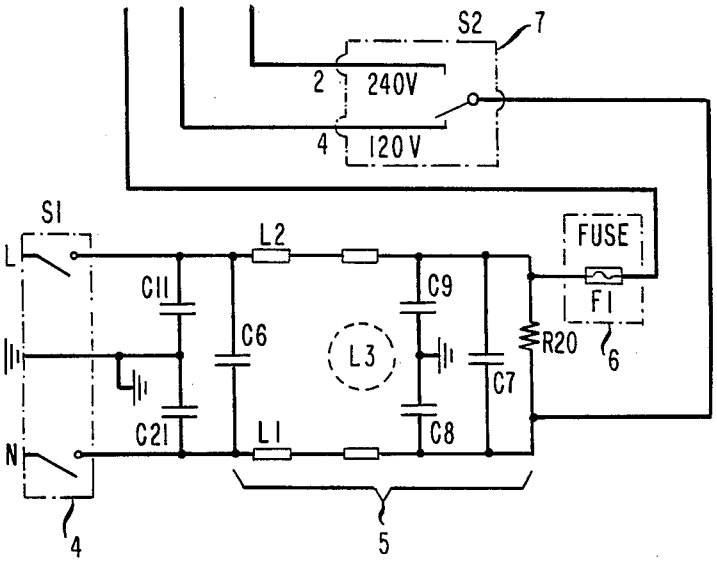

OFFICE MACHINE, IN PARTICULAR MATRIX PRINTER

BACKGROUND OF THE INVENTION

1. Field of the Invention

The invention relates to an office machine, in particular to a matrix printer with a power supply for furnishing current for the electrical or, respectively, electronic circuits and with a power grid side safety fuse.

2. Brief Description of the Background of the Invention Including Prior Art

Such office machines are equipped because of the different voltage systems in the individual countries with voltage switches such that the user of the office machine can set the voltage desired at a voltage switch before taking the office machine into operation. Such means, however, are cumbersome and complicated in their construction and in their operation and furthermore entail relatively high equipment costs.

A connection combination is known to a practitioner, which provides a voltage change by an exchange of the respective fuse against another fuse with a changed voltage and which in addition comprises a switch, which has to be set to a new voltage step. Such a connection combination is complicated to operate and confusing. In addition, such connection combinations are relatively expensive and require substantial assembly work, because of the wiring. Furthermore, there exists the danger of operating errors, which have in the past resulted in equipment failures.

SUMMARY OF THE INVENTION

1. Purposes of the Invention

It is an object of the present invention to provide a device for office machines and in particular for matrix printers where the voltage change can be performed without particular reconstruction measures and without complicated handling.

It is a further object of the present invention to provide a power change system for office machines, which is associated with a clear and easy operating mode.

These and other objects and advantages of the present invention will become evident from the description which follows.

2. Brief Description of the Invention

The present invention provides an office machine which comprises an electrical or, respectively, electronic circuit, a multiple safety fuse socket for at least two melting safety fuse bodies and disposed on an electrical input side of the office machine and connected in series to a power grid, a power supply for providing current power of the electrical or, respectively, electronic circuit and including a fuse on the input side toward the power grid, a voltage selection switch connected to the the multiple safety fuse socket for at least two melting safety fuse bodies. The multiple safety fuse socket is insertable in different positions relative to the voltage selection switch. A selected voltage at the voltage selection switch is coordinated to each position of the multiple safety fuse socket.

The office machine can be a matrix printer. A switching nose can be disposed at the multiple fuse socket and engaging into an operating position in the voltage selection switch. The multiple safety fuse socket comprises a molded plastic part with separate compartments for melting safety fuse bodies of a different size. The multiple safety fuse socket can have a compartment. At one end of a wide side of a wall of the compartment the switching nose is provided as a protrusion. The power supply preferably comprises input connector contacts and a filter group connected to the input connector contacts.

The multiple safety fuse socket is preferably formed of a one-piece molded plastic part having a handle and a front wall and a partition wall. The partition wall separates two compartments each for a melting safety fuse body. A switching nose can be disposed at the multiple fuse socket, extending in a direction substantially in parallel to the partition wall. A semisphere shaped switch actuator has two operating positions. The switching nose furnishes a position of the switch actuator into a first operating position in the voltage selection switch based upon a first orientation of the multiple safety fuse socket. The switching nose furnishes a second switching position to the switch actuator into a second operating position in the voltage selection switch based upon a second orientation of the multiple safety fuse socket. The multiple safety fuse socket comprises separate compartments for melting safety fuse bodies of a different size. The switching nose can be formed as a bent protrusion. Upon a breaking of the switching nose a setting of the switch actuator can result, which setting corresponds to the highest contemplated input power grid voltage.

The two compartments can contain different dimensions of sockets for distinguishing the types of fuses to be loaded. The cover depending upon shifting direction can alternatingly depend upon cover a power receptacle of the office machine or the multiple safety fuse socket. The wall of the office machine can support the power receptacle of the office machine and the multiple safety fuse socket, wherein said wall includes a slider support. The cover is formed as a slider in said wall of the office machine.

A voltage selection switch is coordinated to a multiple safety fuse socket for at least two melting fuse bodies. The multiple safety fuse socket can be inserted into the frame in different positions relative to the voltage selection switch into a safety fuse socket. In each position of the multiple safety fuse socket a selected voltage is coordinated at the voltage selection switch. This principle can be employed for at least two or more voltage stages. Only one defined position of the multiple safety fuse switch is to be selected for each voltage stage. Thus, the system is clear and simple to operate.

A feature of the invention provides that the multiple safety fuse socket comprises a molded plastic part with separated compartments for the melting safety fuse bodies of different sizes. A switching nose is disposed at one compartment wall engaging in operating position into the voltage selection switch. The invention requires in addition to the corresponding commercially available construction of the voltage selection switch only a single part, which is the molded plastic part.

It is further provided for improving the molded plastic part that the switching nose is provided at one end of the wide side of the compartment wall as a protrusion. This form assures good understanding of the operator upon switching as to the desired voltage value he is selecting.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

FIG. 3 is a front view of a multiple safety fuse socket.

FIG. 4 is a plan view from above unto the multiple safety fuse socket according to FIG. 3.

FIG. 5 is a side view of the multiple safety fuse socket and

FIG. 6 is a switching circuit of the matrix printer power grip connection part with the voltage switching arrangement.

DESCRIPTION OF INVENTION AND PREFERRED EMBODIMENT

Figure 1:
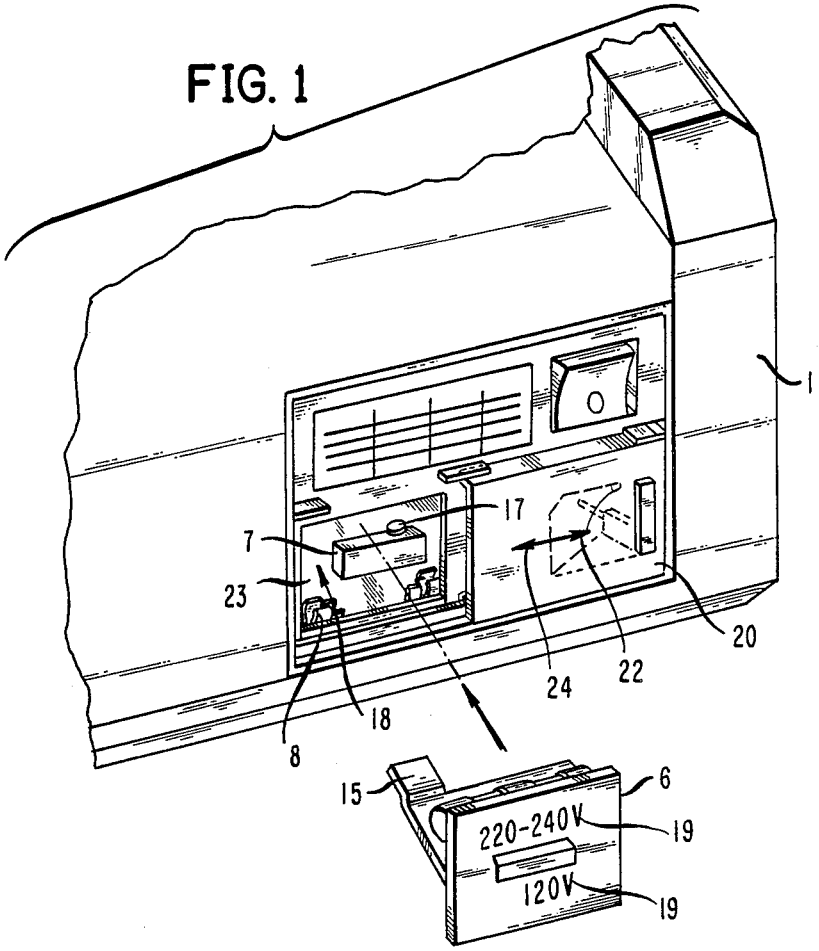
FIG. 1 is a partial perspective view of the back side of a matrix printer with the power connection.

In accordance with the present invention there is provided an office machine, in particular a matrix printer, which has a power supply 3 for providing current power of the electrical or, respectively, electronic circuits and has a fuse on the input side toward the power grid. A multiple safety fuse socket 6 for at least two melting safety fuse bodies 9,10 is connected to a voltage selection switch 7. The multiple safety fuse socket is insertable in different positions relative to the voltage selection switch 7. A selected voltage at the voltage selection switch 7 is coordinated to each position of the multiple safety fuse socket 6.

The multiple safety fuse socket 6 can comprise a molded plastic part 6*a* with separate compartments 12*a*, 12*b* for the melting safety fuse bodies 9, 10 of a different size and where a switching nose 15 is engaging into an operating position in the voltage selection switch 7. The switching nose 15 is preferably provided at one end of the wide side of the wall partition 14 of the compartment as a protrusion.

The matrix printer exhibits at its casing in a region at the rear wall 1 of the platen 2 a power supply 3. The power supply 3 comprises essentially a connection contact 4, a filter group 5, which filters disturbances and perturbances coming from the outside of the apparatus and which consequently deals with power associated disturbances, a multiple safety fuse socket 6 and a voltage selection switch 7 (FIG. 6). The voltage selection switch 7 is disposed opposite to socket 8 for the safety fuse. The multiple safety fuse socket 6 is illustrated in more details in FIGS. 3 to 5. There are two different melting safety fuse bodies 9 and 10 for 220 to 240 V or, respectively, for 120 V present. The multiple safety fuse socket is electrically connected to two clamping sockets 8 provided at a bottom plate of the office machine, which clamping sockets contact upon placing of the multiple safety fuse socket into the frame the two poles of a selected fuse or, respectively, of its contact attached to and contained in the multiple safety fuse socket.

Figure 2:
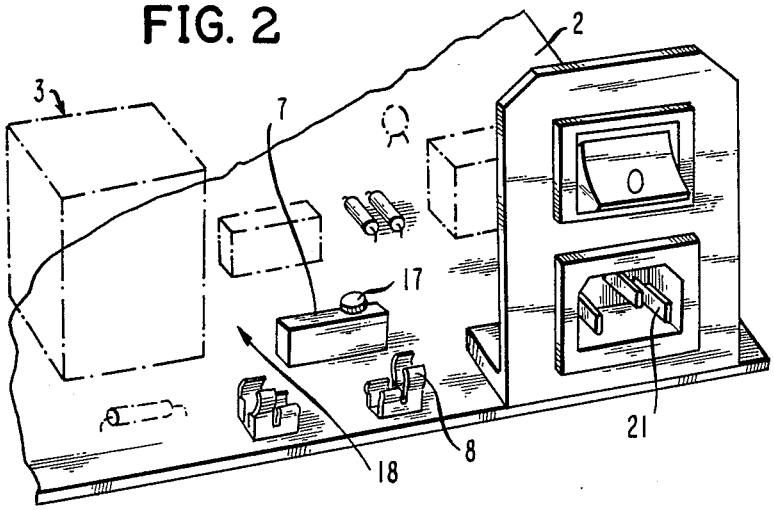
FIG. 2 is a partial perspective view of the back side according to FIG. 1 with a removal of the casing.

The multiple safety fuse socket 6 (FIGS. 3 to 5) comprises a single piece of molded plastic part 6*a* with a handle 11 and two separated compartments 12*a* and 12*b*, which are separated by a front wall 13 rear partition and a wall 14 such that the melting safety fuse bodies 9 and 10 are disposed at a corresponding safety distance. A switching nose 15 is formed at the left side of the molded plastic part 6*a*, which safety nose as illustrated passes by at the voltage selection switch 7 on the left hand side 18 as illustrated in FIG. 2, in case where an operating voltage from 220 to 240 V is desired. For the other second case of an operating voltage of 120 V, the multiple safety fuse socket 6 is turned around by 180 degrees such, that the melting safety fuse body 10 for 120 V comes to rest downwardly and the switching nose presses downward toward the right the semisphere shaped actuation switch 17. The switching nose 15 is constructed for the actuation of the actuation switch 17 as a bent protrusion 16. Since the melting safety fuse bodies 9 and 10 are provided with different dimensions for different voltages, therefore it is impossible because of the different sockets to place these melting safety fuse bodies 9 and 10 into a wrong positions versus the instruction 19 (FIG. 1) placed on the molded plastic part. A further protection is provided by the voltage selection switch 7, which upon breaking of the switching nose 15 is automatically set to the higher voltage value. Such voltage selection switches 7 are commercially available.

A further protection against operator errors is provided by a cover 20. The cover 20 comprises the receptacle plug with contact pins 21. In this position, the appliance coupler is removed, that is the office machine is necessarily out of operation.

The multiple safety switch 6 can be removed only in this position. In other words, first, the appliance plug has to be pulled out, then the cover 20 has to be shifted in the direction 22 in order to provide access to the opening 23, that is to the multiple safety fuse socket 6. After turning of the multiple safety fuse socket 6 by 180 degrees according to the embodiment illustrated, and upon reinsertion against the voltage selection switch 7, then the cover 20 can be shifted back over the direction 24, such that the appliance plug can be reinserted into the receptacle plug with contact pins 21.

It will be understood that each of the elements described above, or two or more together, may also find a useful application in other types of office machines, in particular matrix printers from the types described above.

While the invention has been illustrated and described as embodied in the context of office machine, in particular matrix printers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An office machine comprising an electrical or, respectively, electronic circuit;

a multiple safety fuse socket for at least two melting safety fuse bodies and disposed on an electrical input side of the office machine and connected in series to a power grid;

a power supply for providing current power of the electrical circuit and including a fuse on the input side toward the power grid;

a voltage selection switch actuatable by insertion of the the multiple safety fuse socket for at least two melting safety fuse bodies, wherein the multiple safety fuse socket is insertable in different positions relative to the voltage selection switch and wherein a selected voltage at the voltage selection switch is coordinated to each position of the multiple safety fuse socket;

a cover which cover alternatingly depending upon shifting direction will cover a power receptacle of the office machine or the multiple safety fuse socket.

2. The office machine according to claim 1 wherein the office machine is a matrix printer.

3. The office machine according to claim 1 further comprising a switching nose disposed at the multiple fuse socket and engaging into an operating position in the voltage selection switch, wherein the multiple safety fuse socket comprises a molded plastic part with separate compartments for melting safety fuse bodies of different size.

4. The office machine according to claim 3 wherein the multiple safety fuse socket has a compartment wherein at one end of a wide side of a wall of the compartment the switching nose is provided as a protrusion.

5. The office machine according to claim 1 wherein the power supply comprises input connector contacts and a filter group connected to the input connector contacts.

6. The office machine according to claim 3 wherein the multiple safety fuse socket is formed of a one-piece molded plastic part having a handle and a front wall and a partition wall, where the partition wall separates two compartments each for a melting safety fuse body.

7. The office machine according to claim 6 further comprising a switching nose disposed at the multiple fuse socket, extending in a direction substantially in parallel to the partition wall;

a semisphere shaped switch actuator having two operating positions wherein the switching nose furnishes a position of the switch actuator into a first operating position in the voltage selection switch based upon a first orientation of the multiple safety fuse socket and wherein the switching nose furnishes a second switching position to the switch actuator into a second operating position in the voltage selection switch based upon a second orientation of the multiple safety fuse socket and wherein the multiple safety fuse socket comprises separate compartments for melting safety fuse bodies of a different size.

8. The office machine according to claim 7 wherein the switching nose is formed as a bent protrusion.

9. The office machine according to claim 7 wherein upon a breaking of the switching nose a setting of the switch actuator results which corresponds to the highest contemplated input power grid voltage.

10. The office machine according to claim 6 wherein the two compartments contain different dimensions of sockets for distinguishing the types of fuses to be loaded.

11. The office machine according to claim 1 further comprising a wall of the office machine for supporting the power receptacle of the office machine and for the multiple safety fuse socket wherein said wall includes a slider support and wherein the sliding cover is formed as a slider in said wall of the office machine.

12. Office machine, in particular a matrix printer, with a power supply (3) for providing current power of the electrical circuits and including a fuse on the input side toward the power grid, wherein the multiple safety fuse socket is insertable in different positions relative to the voltage selection switch (7), where a selected voltage at the voltage selection switch (7) is coordinated to each position of the multiple safety fuse socket (6), wherein a multiple safety fuse socket (6) for at least two melting safety fuse bodies (9,10) actuates a voltage selection switch (7) and where a sliding cover alternatingly as desired covers a power receptacle of the office machine or the multiple safety fuse socket depending upon shifting direction.

13. The office machine according to claim 12 wherein the multiple safety fuse socket (6) comprises a molded plastic part (**6*a*) with separate compartments (12*a*, 12*b*) for the melting safety fuse bodies (9, 10) of different size and where a switching nose (15) is engaging into an operating position in the voltage selection switch (7**).

14. The office machine according to claim 13 wherein the switching nose (15) is provided at one end of the wide side of the wall of the compartment (14) as a protrusion.

15. The office machine according to claim 12 further comprising a wall of the office machine for supporting the power receptacle of the office machine and for the multiple safety fuse socket wherein said wall includes a slider support and wherein the sliding cover is formed as a slider in said wall of the office machine.

16. The office machine according to claim 12 further comprising a wall of the office machine for supporting the power receptacle of the office machine and for the multiple safety fuse socket wherein said wall includes a slider support and wherein the sliding cover is formed as a slider in said wall of the office machine;

a switching nose disposed at the multiple fuse socket and engaging into an operating position in the voltage selection switch, wherein the multiple safety fuse socket comprises a molded plastic part with separate compartments for melting safety fuse bodies of different size, said switching nose extending in a direction substantially in parallel to the partition wall, wherein the switching nose is formed as a bent protrusion and wherein upon a breaking of the switching nose a setting of the switch actuator results which corresponds to the highest contemplated input power grid voltage;

a semisphere shaped switch actuator having two operating positions wherein the switching nose furnishes a position of the switch actuator into a first operating position in the voltage selection switch based upon a first orientation of the multiple safety fuse socket and wherein the switching nose furnishes a second switching position to the switch actuator into a second operating position in the voltage selection switch based upon a second orientation of the multiple safety fuse socket and wherein the multiple safety fuse socket comprises separate compartments for melting safety fuse bodies of a different size and wherein the multiple safety fuse socket has a compartment wherein at one end of a wide side of a wall of the compartment the switching nose is provided as a protrusion;

wherein the office machine is a matrix printer;

wherein the power supply comprises input connector contacts and a filter group connected to the input connector contacts;

wherein the multiple safety fuse socket is formed of a one-piece molded plastic part having a handle and a front wall and a partition wall, where the partition wall separates two compartments each for a melting safety fuse body and wherein the two compartments contain different dimensions of sockets for distinguishing the types of fuses to be loaded.

17. The office machine according to claim 1 further comprising a wall of the office machine for supporting the power receptacle of the office machine and for the multiple safety fuse socket wherein said wall includes a slider support and wherein the sliding cover is formed as a slider in said wall of the office machine;

a switching nose disposed at the multiple fuse socket and engaging into an operating position in the voltage selection switch, wherein the multiple safety fuse socket comprises a molded plastic part with separate compartments for melting safety fuse bodies of different size, said switching nose extending in a direction substantially in parallel to the partition wall, wherein the switching nose is formed as a bent protrusion and wherein upon a breaking of the switching nose a setting of the switch actuator results which corresponds to the highest contemplated input power grid voltage;

a semisphere shaped switch actuator having two operating positions wherein the switching nose furnishes a position of the switch actuator into a first operating position in the voltage selection switch based upon a first orientation of the multiple safety fuse socket and wherein the switching nose furnishes a second switching position to the switch actuator into a second operating position in the voltage selection switch based upon a second orientation of the multiple safety fuse socket and wherein the multiple safety fuse socket comprises separate compartments for melting safety fuse bodies of a different size and wherein the multiple safety fuse socket has a compartment wherein at one end of a wide side of a wall of the compartment the switching nose is provided as a protrusion;

wherein the office machine is a matrix printer;

wherein the power supply comprises input connector contacts and a filter group connected to the input connector contacts;

wherein the multiple safety fuse socket is formed of a one-piece molded plastic part having a handle and a front wall and a partition wall, where the partition wall separates two compartments each for a melting safety fuse body and wherein the two compartments contain different dimensions of sockets for distinguishing the types of fuses to be loaded.

18. The office machine according to claim 1 further comprising a molded plastic part with separate compartments for the melting safety fuse bodies of a different size;

a wall partition of the molded plastic part having a wide side;

a nose engaging as a protrusion into an operating position in the voltage selection switch furnished at one end of the wide side of the wall partition of the compartment;

wherein the power supply is disposed in a region at the rear wall of the casing relative to a platen and wherein the power supply includes a connection contact, a filter group, which filter group filters disturbances and perturbances coming from the outside of the apparatus and which filter group consequently deals with power associated disturbances; wherein the voltage selection switch is disposed opposite to the multiple safety fuse socket for the safety fuse;

wherein the multiple safety fuse socket is electrically connected to two clamping sockets provided at a bottom plate of the office machine, which clamping sockets contact upon placing of the multiple safety fuse socket into the frame the two poles of a selected fuse or, respectively, of its contact attached to and contained in the multiple safety fuse socket.

19. The office machine according to claim 1 further comprising a single piece of molded plastic part of the multiple safety fuse having a handle and two separated compartments, which compartments are separated by a front wall rear partition and a wall such that the melting safety fuse bodies are disposed at a corresponding safety distance;

a switching nose formed at the left side of the molded plastic part, wherein the safety nose passes by at the voltage selection switch and wherein the multiple safety fuse socket is turned around by 180 degrees for selecting a second voltage position such that the melting safety fuse body for the first voltage comes to rest downwardly and the switching nose presses downward toward a semisphere shaped actuation switch and wherein the switching nose is constructed as a bent protrusion for the actuation of the actuation switch and wherein the multiple melting safety fuse bodies each are provided with different dimensions for a respective different voltage rendering it impossible to place these multiple melting safety fuse bodies into a wrong positions because of the different sockets, wherein the voltage selection switch upon breaking of the switching nose is automatically set to the higher voltage value; and wherein the cover comprises a receptacle plug with contact pins such that removal of the appliance coupler puts the office machine necessarily out of operation.

* * * * *